US010670343B2

(12) United States Patent
Kim et al.

(10) Patent No.: US 10,670,343 B2
(45) Date of Patent: Jun. 2, 2020

(54) MICRO CHANNEL TYPE HEAT EXCHANGER

(71) Applicant: LG ELECTRONICS INC., Seoul (KR)

(72) Inventors: Beomchan Kim, Seoul (KR); Byoungjin Ryu, Seoul (KR); Taeman Yang, Seoul (KR); Choonmyun Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 390 days.

(21) Appl. No.: 15/258,200

(22) Filed: Sep. 7, 2016

(65) Prior Publication Data

US 2017/0067690 A1 Mar. 9, 2017

(30) Foreign Application Priority Data

Sep. 7, 2015 (KR) ..... 10-2015-0126503

(51) Int. Cl.
*F28D 1/04* (2006.01)
*F28D 1/053* (2006.01)
(Continued)

(52) U.S. Cl.
CPC ..... *F28D 1/0417* (2013.01); *F25B 39/00* (2013.01); *F28D 1/0435* (2013.01); *F28D 1/05391* (2013.01); *F28F 1/124* (2013.01); *F28F 9/0202* (2013.01); *F28F 9/028* (2013.01); *F28F 9/0209* (2013.01); *F25B 39/02* (2013.01);
(Continued)

(58) Field of Classification Search
CPC .. F28D 1/0417; F28D 1/0435; F28D 1/05391; F28D 1/417; F28D 2021/0071; F28D 2021/0085; F25B 39/00; F25B 39/02
See application file for complete search history.

(56) References Cited

U.S. PATENT DOCUMENTS 6,250,103 B1 * 6/2001 Watanabe ..... F25B 39/04 62/509
6,394,176 B1 5/2002 Marsais
(Continued)

FOREIGN PATENT DOCUMENTS

EP 1 992 890 A1 11/2008
JP 03-211377 A 9/1991
(Continued)

*Primary Examiner* — Gordon A Jones
(74) *Attorney, Agent, or Firm* — Dentons US LLP

(57) ABSTRACT

A micro channel type heat exchanger having a first pass disposed in some flat tubes located in a first heat exchange module and along which a refrigerant flows in one direction, a second pass disposed in some of the remaining flat tubes located in the first heat exchange module and along which the refrigerant supplied from the first pass flows in an opposite direction to that of the first pass, a third pass distributed and located in the remainder of flat tubes located in the first heat exchange module other than the first pass and the second pass and in some flat tubes located in a second heat exchange module, and a fourth pass disposed in the remainder of the flat tubes located in the second heat exchange module and along which a refrigerant supplied from the third pass flows in an opposite direction to a direction of the third pass.

13 Claims, 7 Drawing Sheets

(51) Int. Cl.

| | |
|---|---|
| ***F28F 9/02*** | (2006.01) |
| ***F25B 39/00*** | (2006.01) |
| ***F28F 1/12*** | (2006.01) |
| *F28D 21/00* | (2006.01) |
| *F25B 39/02* | (2006.01) |

(52) U.S. Cl.
CPC ..... *F28D 2021/0071* (2013.01); *F28D 2021/0085* (2013.01); *F28F 2270/00* (2013.01)

(56) References Cited

U.S. PATENT DOCUMENTS

| | | | | |
|---|---|---|---|---|
| 9,625,219 | B2 * | 4/2017 | Takagi ..... | F28F 9/0207 |
| 2009/0173102 | A1 * | 7/2009 | Ogasawara ..... | F25B 39/04 62/498 |
| 2011/0303401 | A1 | 12/2011 | Kamoshida et al. | |
| 2014/0311703 | A1 | 10/2014 | Takagi | |

FOREIGN PATENT DOCUMENTS

| | | | |
|---|---|---|---|
| JP | 2004-144395 | A | 5/2004 |
| JP | 2008-111624 | A | 5/2008 |
| JP | 2011-257111 | A | 12/2011 |
| JP | 2013-234839 | A | 11/2013 |
| WO | 2011/005986 | A2 | 1/2011 |

* cited by examiner

MICRO CHANNEL TYPE HEAT EXCHANGER

CROSS-REFERENCE TO RELATED APPLICATION

The application claims priority under 35 U.S.C. § 119 to Korean Patent Application No. 10-2015-0126503, filed on Sep. 7, 2015, whose entire disclosure is hereby incorporated by reference.

BACKGROUND OF THE INVENTION

1. Field of the Invention

A micro channel type heat exchanger.

2. Discussion of the Related Art

In general, a heat exchanger may be used as a condenser or evaporator in a freezing cycle device including a compressor, a condenser, an expansion unit, and an evaporator. The heat exchanger may be divided into a pin tube type heat exchanger and a micro channel type heat exchanger depending on its structure.

Generally, the pin tube type heat exchanger is made of copper and the micro channel type heat exchanger is made of aluminum. The micro channel type heat exchanger generally has better efficiency than the pin tube type heat exchanger because a fine flow channel is formed therein. Moreover, the pin tube type heat exchanger can be easily fabricated because a pin and a tube are welded. In contrast, the micro channel type heat exchanger generally has a higher initial investment cost because it is fabricated using a brazing process. The pin tube type heat exchanger can be easily fabricated with them stacked in two columns because it can be easily fabricated, whereas the micro channel type heat exchanger has a difficulty in fabrication in two columns because it is put into a furnace and fabricated.

FIG. 1 is a perspective view of a conventional micro channel type heat exchanger described in Korean Patent No. 10-0765557, which is incorporated herein by reference.

As shown, the conventional micro channel type heat exchanger includes a first column 1 and a second column 2, and includes a header 3 connecting the first column 1 and the second column 2. The header 3 provides a flow channel for changing the direction of the refrigerant of the first column 1 to the second column 2. In the conventional micro channel type heat exchanger including the two columns, the inflow hole 4 of a refrigerant is disposed below the first column 1, and the discharge hole 5 of a refrigerant on the lower side of the second column 2.

In particular, a plurality of the inflow holes 4 are formed. A refrigerant is supplied to the first column 1 through a plurality of flow channels. In the first column 1, a refrigerant flows from bottom to top. In the second column 2, the refrigerant passes through the header 3 and flows from top to bottom. A single discharge hole 5 is disposed therein. That is, fluids passing through the first column 1 are joined at a place of the second column 2, collected in the discharge hole 5, and then discharged.

If the conventional micro channel type heat exchanger is used as an evaporator, there is a problem in that a pressure loss is generated because a refrigerant is evaporated during the process of the refrigerant flowing from the first column 1 to the second column 2.

SUMMARY OF THE INVENTION

An embodiment of the present invention is directed to a heat exchanger having a configuration that is capable of reducing the pressure loss of a refrigerant if it is used as an evaporator.

An embodiment of the present invention is directed to the provision of a heat exchanger configured to operate as a single pass in two stacked heat exchange modules.

An embodiment of the present invention is directed to the provision of a ratio of each pass capable of reducing the pressure loss of a refrigerant if it is used as an evaporator.

Technical objects to be achieved by the present invention are not limited to the aforementioned objects, and those skilled in the art to which the present invention pertains may understand other technical objects from the following description.

According to an embodiment of the present disclosure, there is provided a micro channel type heat exchanger in which a first heat exchange module and a second heat exchange module having a plurality of flat tubes disposed in the exchange modules are stacked. The micro channel type heat exchanger includes a first pass which is disposed in some of the plurality of flat tubes disposed in the first heat exchange module and along which a refrigerant flows in one direction; a second pass which is disposed in remaining some of the plurality of flat tubes disposed in the first heat exchange module and along which the refrigerant supplied from the first pass flows in the opposite direction to the direction of the first pass; a third pass which is distributed and disposed in the remainder of the plurality of flat tubes disposed in the first heat exchange module other than the first pass and the second pass and in some of a plurality of flat tubes disposed in the second heat exchange module; and a fourth pass which is disposed in the remainder of the plurality of flat tubes disposed in the second heat exchange module and along which a refrigerant supplied from the third pass flows in the opposite direction to the direction of the third pass. The third pass includes a (3-1)-th pass which is disposed in the remainder of the plurality of flat tubes disposed in the first heat exchange module other than the first pass and the second pass and along which the refrigerant supplied from the second pass flows in the opposite direction to the direction of the second pass and a (3-2)-th pass which is disposed in some of the plurality of flat tubes disposed in the second heat exchange module and along which the refrigerant supplied from the second pass flows in the opposite direction to the direction of the second pass and flows a direction identical to the direction of the (3-1)-th pass.

The number of flat tubes disposed in each of the first pass, the second pass, the third pass, and the fourth pass may be gradually increased.

The third pass may include 30% to 50% of all of the flat tubes of the first heat exchange module and the second heat exchange module.

The first pass and the second pass may include 50% or less of all of the flat tubes of the first heat exchange module and the second heat exchange module.

15% of all of the flat tubes of the first heat exchange module and the second heat exchange module may be disposed in the first pass, 20% of all of the flat tubes of the first heat exchange module and the second heat exchange module may be disposed in the second pass, 30% of all of the flat tubes of the first heat exchange module and the second heat exchange module may be disposed in the third pass, and 35% of all of the flat tubes of the first heat exchange module and the second heat exchange module may be disposed in the fourth pass.

The number of flat tubes disposed in the (3-1)-th pass may be identical with the number of flat tubes disposed in the (3-2)-th pass.

The number of flat tubes disposed in the (3-2)-th pass may be greater than the number of flat tubes disposed in the (3-1)-th pass.

The micro channel type heat exchanger may further include a first separation space formed between the first pass and the second pass, a second separation space formed between the second pass and the (3-1)-th pass, and a third separation space formed between the (3-2)-th pass and the fourth pass.

The (3-1)-th pass and the (3-2)-th pass may be connected.

The first heat exchange module may include the plurality of flat tubes configured to have a refrigerant flow along the flat tubes; a pin configured to connect the flat tubes and to conduct heat; a first lower header connected to one side of the plurality of flat tubes and configured to communicate with one side of the plurality of flat tubes so that the refrigerant flows; a first upper header connected to the other side of the plurality of flat tubes and configured to communicate with the other side of the plurality of flat tubes so that the refrigerant flows; a first baffle disposed within the first lower header and configured to form the first pass and the second pass by partitioning an inside of the first lower header; and a second baffle disposed within the first upper header and configured to form the second pass and the (3-1)-th pass by partitioning an inside of the second upper header.

The second heat exchange module may include the plurality of flat tubes configured to have a refrigerant flow in the flat tubes; a pin configured to connect the flat tubes and to conduct heat; a second lower header connected to one side of the plurality of flat tubes and configured to communicate with one side of the plurality of flat tubes so that a refrigerant flows; a second upper header connected to the other side of the plurality of flat tubes and configured to communicate with the other side of the plurality of flat tubes so that the refrigerant flows; and a third baffle disposed within the second lower header and configured to form the (3-2)-th pass and the fourth pass by partitioning the second lower header.

The micro channel type heat exchanger may further include an inflow pipe disposed in the first lower header of the first pass and configured to supply the refrigerant and a discharge pipe disposed in the second lower header of the fourth pass and configured to discharge the refrigerant.

A first upper hole may be formed in the first upper header in which the (3-1)-th pass has been formed, a second upper hole may be formed in the second upper header in which the (3-2)-th pass has been formed, and some of the refrigerant of the third pass flows in the second upper header through the first upper hole and the second upper hole.

A first lower hole may be formed in the first lower header in which the (3-1)-th pass has been formed, a second lower hole may be formed in the second lower header in which the (3-2)-th pass has been formed, and some of the refrigerant of the third pass flows in the second lower header through the first lower hole and the second lower hole.

A first upper hole may be formed in the first upper header in which the (3-1)-th pass has been formed, a second upper hole may be formed in the second upper header in which the (3-2)-th pass has been formed, and some of the refrigerant of the third pass flows in the second upper header through the first upper hole and the second upper hole. A first lower hole may be formed in the first lower header in which the (3-1)-th pass has been formed, a second lower hole may be formed in the second lower header in which the (3-2)-th pass has been formed, and the remainder of the refrigerant of the third pass flows in the second lower header through the first lower hole and the second lower hole.

The number of flat tubes forming the (3-1)-th pass may be identical with the number of flat tubes forming the (3-2)-th pass.

The number of flat tubes disposed in each of the first pass, the second pass, the third pass, and the fourth pass may be gradually increased.

15% of all of the flat tubes of the first heat exchange module and the second heat exchange module may be disposed in the first pass, 20% of all of the flat tubes of the first heat exchange module and the second heat exchange module may be disposed in the second pass, 30% of all of the flat tubes of the first heat exchange module and the second heat exchange module may be disposed in the third pass, and 35% of all of the flat tubes of the first heat exchange module and the second heat exchange module may be disposed in the fourth pass.

The micro channel type heat exchanger may further include a first separation space formed between the first pass and the second pass, a second separation space formed between the second pass and the (3-1)-th pass, and a third separation space formed between the (3-2)-th pass and the fourth pass.

The first baffle may be disposed over or under the first separation space, the second baffle may be disposed over or under the second separation space, and the third baffle may be disposed over or under the third separation space.

The (3-1)-th pass and the (3-2)-th pass may be connected through the first lower header and the second lower header and may be connected through the first upper header and the second upper header.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Figure 1:
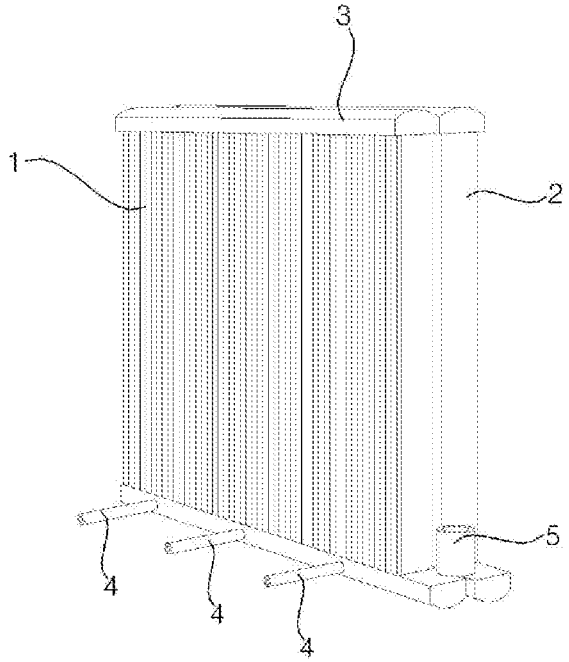
FIG. 1 is a perspective view of a conventional micro channel type heat exchanger.
Figure 2:
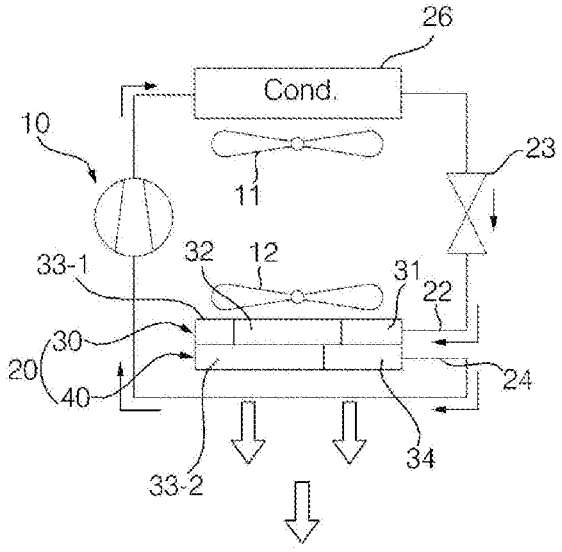
FIG. 2 is a block diagram of an air-conditioner according to an embodiment of the present disclosure.
Figure 3:
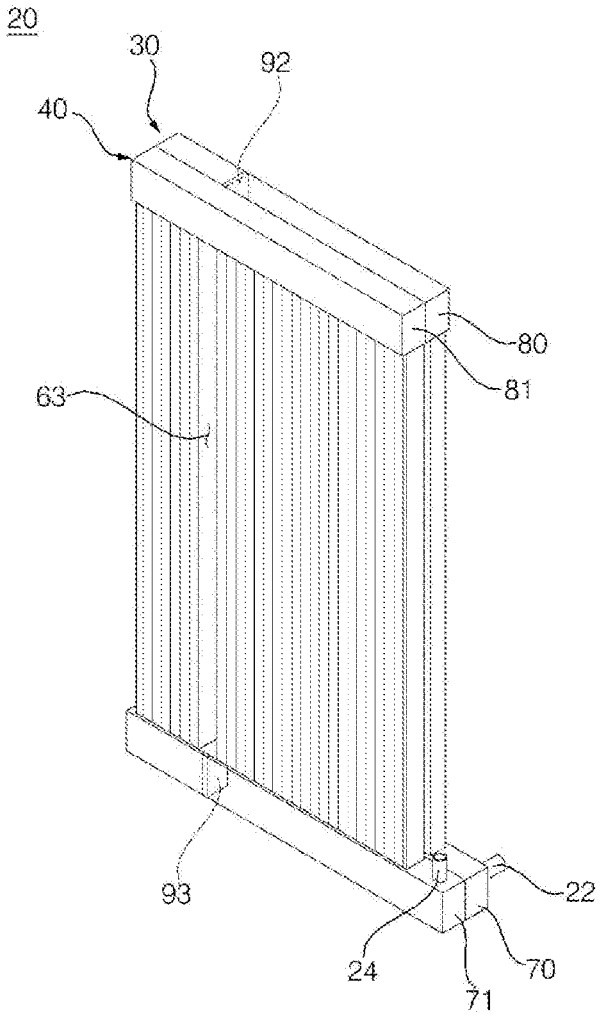
FIG. 3 is a perspective view of an evaporation heat exchanger of FIG. 2.
Figure 4:
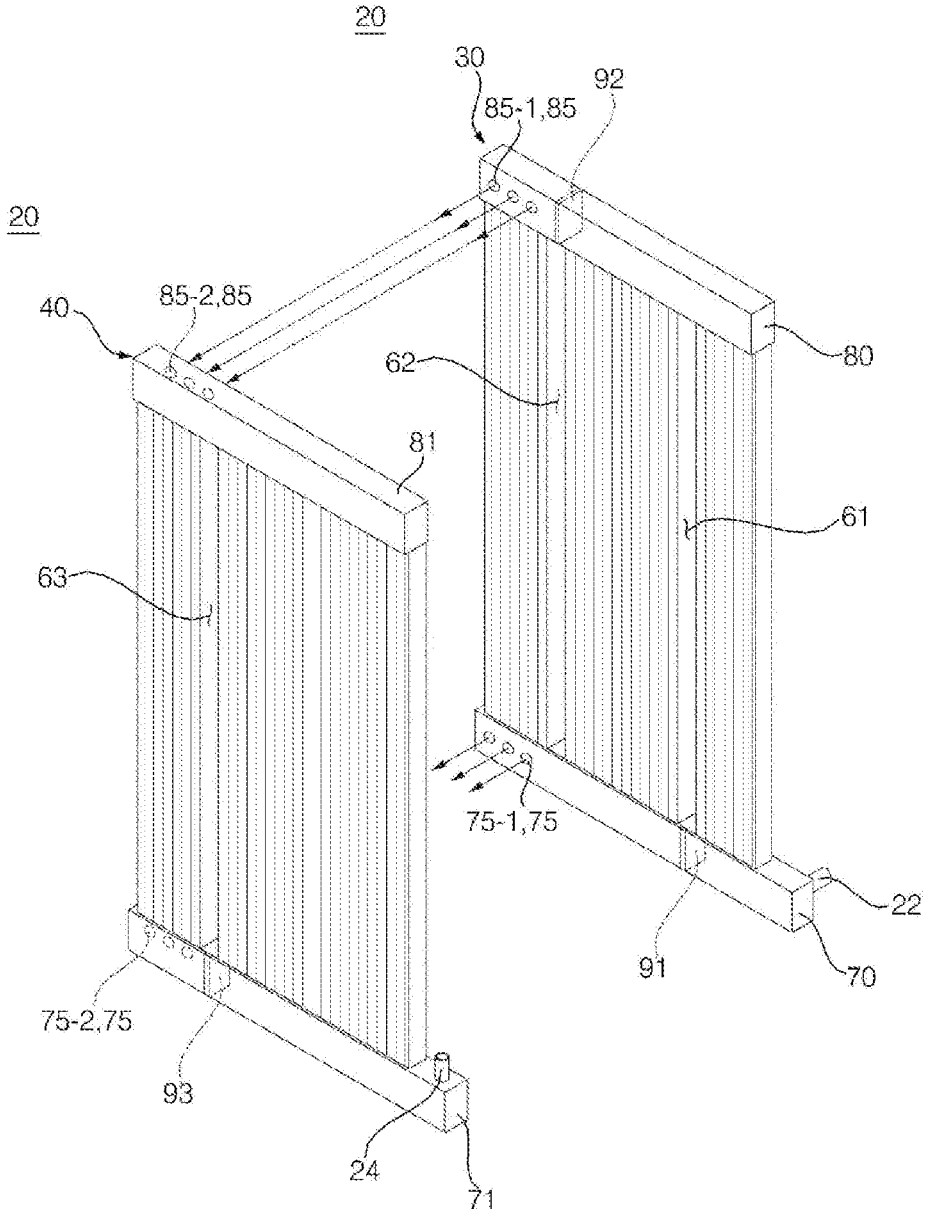
FIG. 4 is an exploded perspective view of the evaporation heat exchanger of FIG. 3.
Figure 5:
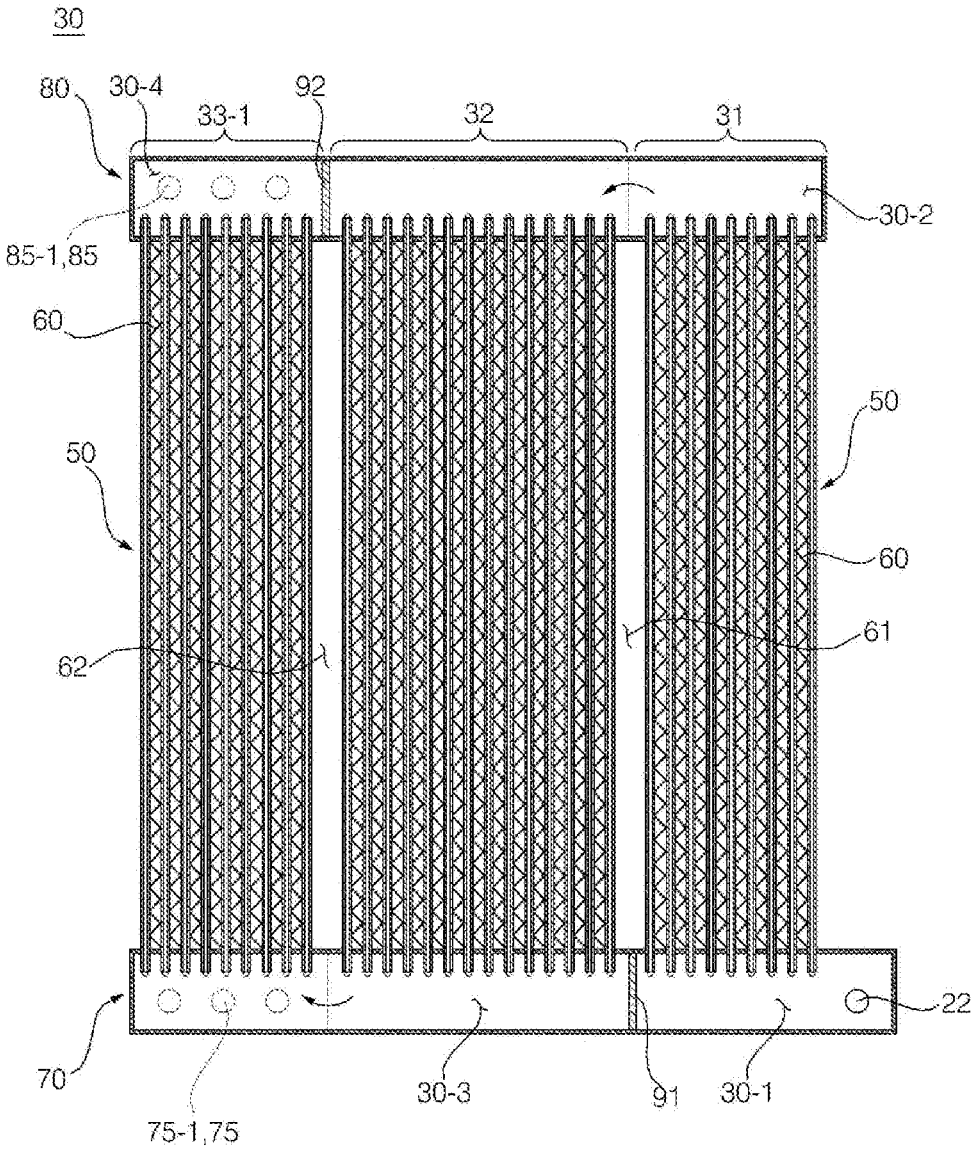
FIG. 5 is a cross-sectional view of a first heat exchange module of FIG. 3.
Figure 6:
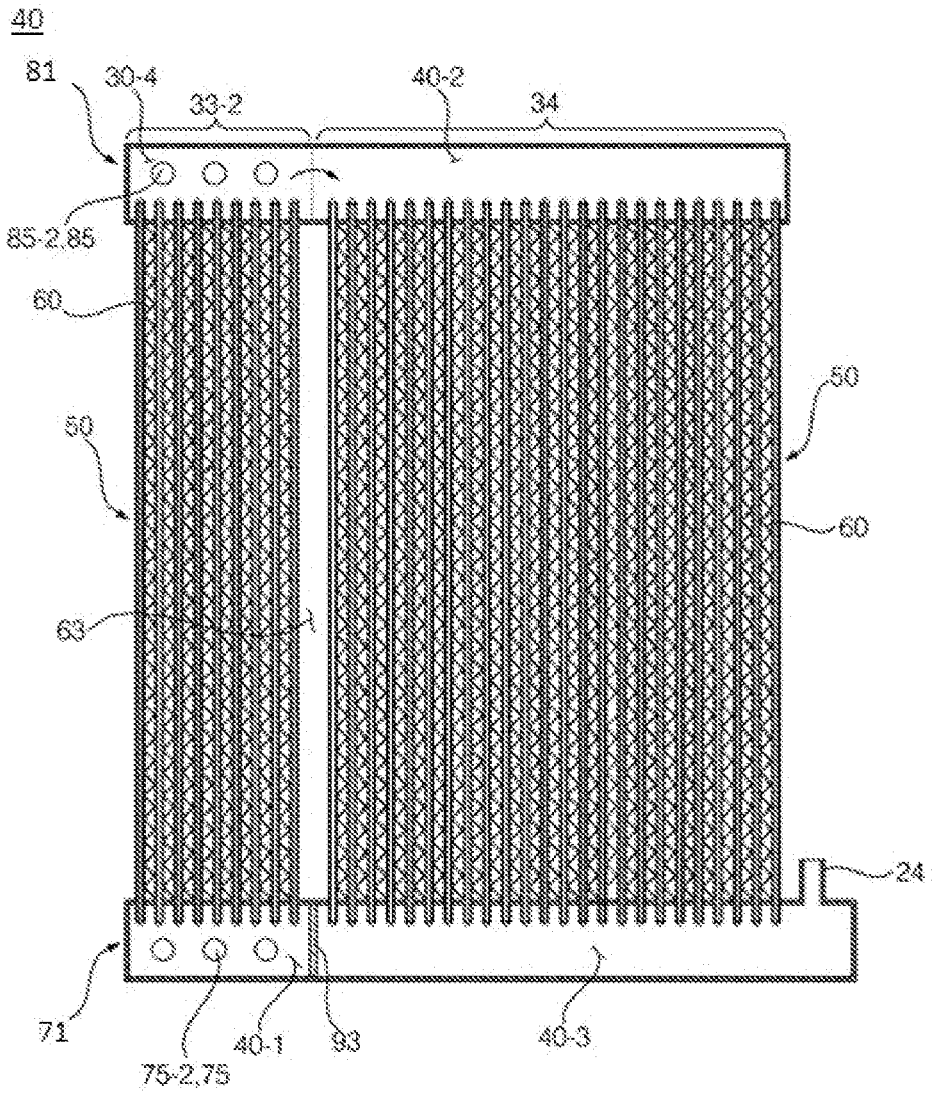
FIG. 6 is a cross-sectional view of a second heat exchange module of FIG. 3.
Figure 7:
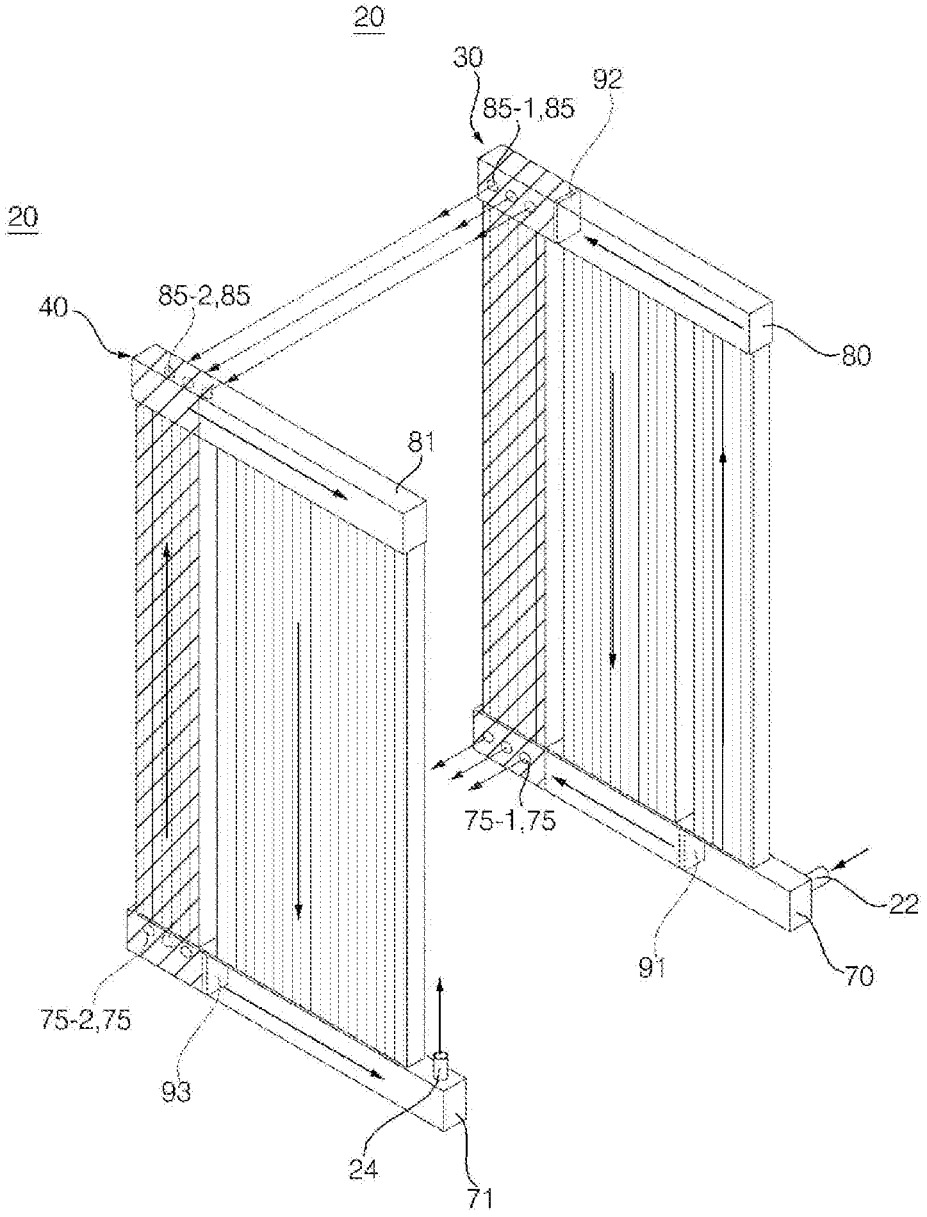
FIG. 7 is an exemplary diagram showing the third pass of the evaporation heat exchanger of FIG. 4.

Hereinafter, embodiments of the present invention are described in detail with reference to the accompanying drawings. Advantages and features of the present invention and a method of achieving the same will be more clearly understood from embodiments described below with reference to the accompanying drawings. However, the present invention is not limited to the following embodiments but may be implemented in various different forms. The embodiments are provided merely to complete disclosure of the present invention and to fully provide a person having ordinary skill in the art to which the present invention pertains with the category of the invention. The invention is defined only by the category of the claims. Wherever possible, the same reference numbers will be used throughout the specification to refer to the same or like elements.

A micro channel type heat exchanger according a first embodiment is described with reference to FIGS. 2 through 7.

As illustrated, the air-conditioner includes a compressor 10 configured to compress a refrigerant, a condensation heat exchanger 26 configured to be supplied with the refrigerant from the compressor 10 and to condense the supplied refrigerant, an expansion unit 23 configured to expand the fluid refrigerant condensed by the condensation heat exchanger, and an evaporation heat exchanger 20 configured to evaporate the refrigerant expanded by the expansion unit 23.

It is understood that the expansion unit 23 may comprise, for example, an electronic expansion valve (eev), or a Bi-flow valve or a capillary tube.

The air-conditioner may further include a condensation ventilation fan 11 configured to flow air into the condensation heat exchanger 26 and an evaporation ventilation fan 12 configured to flow air into the evaporation heat exchanger 20.

An accumulator (not shown) may be disposed between the evaporation heat exchanger 20 and the compressor 10. The accumulator stores a fluid refrigerant and supplies a gaseous refrigerant to the compressor 10.

The evaporation heat exchanger 20 is a micro channel type heat exchanger. As shown, the evaporation heat exchanger 20 may be fabricated in two columns and have a stacked dual pass. The evaporation heat exchanger 20 may be made of aluminum, but is not limited thereto.

The evaporation heat exchanger 20 may have a first heat exchange module 30 and a second heat exchange module 40 stacked on the first heat exchange module 30. The first heat exchange module 30 and the second heat exchange module 40 may be stacked vertically and are stacked front and back in the upright state. In the first heat exchange module 30 and the second heat exchange module 40, a refrigerant flows from top to bottom or from bottom to top.

The refrigerant flows from the first heat exchange module 30 to the second heat exchange module 40.

The first heat exchange module 30 and the second heat exchange module 40 have a similar configuration; therefore, for convenience purposes, the configuration of the first heat exchange module will generally be described.

The first heat exchange module 30 may include a plurality of flat tubes 50 configured to have a plurality of flow channels formed therein, a fin 60 configured to connect the flat tubes 50 and to conduct heat, a first lower header 70 connected to one side of the plurality of flat tubes 50 and configured to communicate with one side of the plurality of flat tubes 50 so that a refrigerant flows therein, a first upper header 80 connected to the other side of the plurality of flat tubes 50 and configured to communicate with the other side of the plurality of flat tubes 50 so that a refrigerant flows therein, and a baffle 90 formed in at least any one of the first lower header 70 and the first upper header 80 and configured to partition the inside of the first lower header 70 or the first upper header 80 to block a flow of a refrigerant.

The second heat exchange module 40 may include a plurality of flat tubes 50 configured to have a plurality of flow channels formed therein, a fin 60 configured to connect the flat tubes 50 and conduct heat, a second lower header 71 connected to one side of the plurality of flat tubes 50 and configured to communicate with one side of the plurality of flat tubes 50 so that a refrigerant flows therein, a second upper header 81 connected to the other side of the plurality of flat tubes 50 and configured to communicate with the other side of the plurality of flat tubes 50 so that a refrigerant flows therein, and a baffle 90 formed in at least ant one of the second lower header 71 and the second upper header 81 and configured to partition the inside of the second lower header 71 or the second upper header 81 to block a flow of a refrigerant.

The flat tubes 50 may be made of metal, but are not limited thereto. For example, in the present embodiment, the flat tube 40 is made of aluminum. The first lower header 70 and the first upper header 80 are also made of aluminum. However, in other embodiments, the elements of the first heat exchange module 30 may be made of another metal, such as copper.

A plurality of the flow channels are formed within the flat tube 50. The flow channel of the flat tube 50 extends in the lengthwise direction thereof. The flat tube 50 is vertically disposed, and a refrigerant flows in an up and down direction.

The flow channel of the flat tube 50 extends in the lengthwise direction thereof.

As shown, the plurality of flat tubes 50 are stacked left and right direction relative to the ground surface.

The upper side of the flat tube 50 may be inserted into the first upper header 80 and communicate with the inside of the first upper header 80.

The lower side of the flat tube 50 may be inserted into the first lower header 70 and communicate with the inside of the first lower header 70.

The fin 60 may be made of metal and conduct heat. Thus, the fin 60 may be made of the same material as the flat tube 50. For example, in the present embodiment, the fin 60 may be made of aluminum.

The fin 60 may be in contact with two flat tubes 50. As shown, the fin 60 is disposed between the two flat tubes 50, and the fin 60 may have a curved shape. Thus, the fin 60 connects the two flat tubes 50 that are stacked left and right and conducts heat.

The baffle 90 is configured to change the flow direction of a refrigerant. The direction of a refrigerant that flows at the left of the baffle 90 and the direction of a refrigerant that flows at the right of the baffle 90 are opposite.

Four passes may be formed in the evaporation heat exchanger 20 due to the baffles 90 installed at the first heat exchange module 30 and the second heat exchange module 40.

For example, a first pass 31, a second pass 32, and part of a third pass 33 may be formed in the first heat exchange module 30. The remainder of the third pass 33 and a fourth pass 34 may be formed in the second heat exchange module 40.

In the present embodiment, for example, part of the third pass 33 formed in the first heat exchange module 30 is referred to herein as a "(3-1)-th pass 33-1," and the remainder of the third pass 33 formed in the second heat exchange module 40 is referred to herein as a "(3-2)-th pass 33-2."

The (3-1)-th pass 33-1 and the (3-2)-th pass 33-2 are physically separated and disposed in the first heat exchange module 30 and the second heat exchange module 40, but operate like a single pass. Additionally, (3-1)-th pass 33-1 and the (3-2)-th pass 33-2 may be distributed and disposed in the two heat exchange modules 30 and 40, and may be stacked and installed.

Thus, a ratio of the third pass 33 to all the passes can be easily controlled because the (3-1)-th pass 33-1 and the (3-2)-th pass 33-2 can be distributed and installed on the two heat exchange modules 30 and 40. Because the (3-1)-th pass 33-1 and the (3-2)-th pass 33-2 can be distributed and disposed, a ratio of the third pass 33 can be controlled in the state in which the number of flat tubes 50 of the first heat exchange module 30 and the number of flat tubes 50 of the second heat exchange module 40 are identically configured.

In the present embodiment, for example, the flat tubes 50 of the first pass 31 and the second pass 32 are physically separated. A space for physically separating the passes is referred to herein as a separation space.

In the present embodiment, for example, a separated space is formed between the first pass 31 and the second pass 32, which is referred to herein as a first separation space 61. Likewise, a separated space is also formed between the second pass 32 and the (3-1)-th pass 33-1, which is referred to herein as a second separation space 62. A separated space is also formed between the (3-2)-th pass 33-2 and the fourth pass 34, which is referred to herein as a third separation space 63.

The separation spaces 61, 62, and 63 block heat from being delivered to an adjacent pass. The separation spaces 61, 62, and 63 may also block heat from being delivered to an adjacent flat tube.

The separation spaces 61, 62, and 63 may be formed by not forming a pin 60 connecting the flat tubes 50.

The baffle 90 may be disposed at the upper or lower side of the separation spaces 61, 62, and 63.

The direction of a refrigerant in the passes may be changed in the upper header 80, 81 or the lower header 70, 71. The baffle 90 may be disposed in the upper header 80, 81 or the lower header 70, 71 in order to change the direction of a refrigerant.

In the present embodiment, for example, an inflow pipe 22 may be connected to the first pass 31, and a discharge pipe 24 may be connected to the fourth pass 34.

The baffle 90 may include a first baffle 91 configured to partition the first pass 31 and the second pass 32, a second baffle 92 configured to partition the second pass 32 and the (3-1)-th pass 33-1, and a third baffle 93 configured to partition the (3-2)-th pass 33-2 and the fourth pass 34.

In the present embodiment, for example, the first baffle 91 and the second baffle 92 may be disposed in the first heat exchange module 30, and the third baffle 93 may be disposed in the second heat exchange module 40. It is understood that the configuration is not limited thereto and the number and locations of the baffles may be changed.

Thus, while the (3-1)-th pass 33-1 and the (3-2)-th pass 33-2 may be disposed in different heat exchange modules, refrigerants in the (3-1)-th pass 33-1 and the (3-2)-th pass 33-2 flow in the same direction.

In the present embodiment, for example, the first baffle 91 may be disposed within the first lower header 70, the second baffle 92 may be disposed within the first upper header 80, and the third baffle 93 may be disposed within the second lower header 71.

The inflow pipe 22 may be disposed in the first lower header 70 of the first pass 31. The discharge pipe 24 may be located in the second lower header 71 of the fourth pass 34. It is understood that if the locations of the inflow pipe 22 and the discharge pipe 24 are changed, the location where the baffle 90 is disposed may be changed.

In an embodiment of the present disclosure, for example, the plurality of heat exchange modules (e.g., the first heat exchange module 30 and the second heat exchange module 40) may be distributed and the third pass 33 may be disposed in the plurality of heat exchange modules.

The inside of the first lower header 70 may be partitioned into a (1-1)-th space 30-1 and a (1-3)-th space 30-3 by the first baffle 91. The inside of the first upper header 80 may be partitioned into a (1-2)-th space 30-2 and a (1-4)-th space 30-4 by the second baffle 92. The inside of the second lower header 71 may be partitioned into a (2-1)-th space 40-1 and a (2-3)-th space 40-3 by the third baffle 93.

A baffle may not disposed within the second upper header 81. The inside of the second upper header 81 is referred to herein as a (2-2)-th space 40-2.

The inflow pipe 22 may be connected to the (1-1)-th space 30-1. The discharge pipe 24 may be connected to the (2-3)-th space 40-3.

The (3-1)-th pass 33-1 and the (3-2)-th pass 33-2 may be connected through the first lower header 70 and the second lower header 71 and connected through the first upper header 80 and the second upper header 81.

In the present embodiment, for example, a lower hole 75 may be formed in order to flow a refrigerant to another heat exchange module. Thus, the lower hole 75 may connect the first lower header 70 and the second lower header 71 and provide a refrigerant flow path. A refrigerant may flow in another heat exchange module through the lower hole 75. It is understood that a pipe may be installed at the lower hole 75, and the pipe may connect the lower holes 75.

In the present embodiment, for example, the lower hole 75 may directly connect the (1-3)-th space 30-3 and the (2-1)-th space 40-1. The lower hole 75 formed in the first heat exchange module 30 is referred to herein as a first lower hole 75-1, and the lower hole 75 formed in the second heat exchange module 40 is referred to herein as a second lower hole 75-2.

The first and the second lower holes 75-1 and 75-2 may connect the second pass 32 and the (3-2)-th pass 33-2. When the first heat exchange module 30 and the second heat exchange module 40 are provided in a furnace, the first and the second lower holes 75-1 and 75-2 are connected. Accordingly, separate welding for connecting the first and the second lower holes 75-1 and 75-2 is not performed.

Accordingly, manufacturing cost and time can be reduced because the first and the second lower holes 75-1 and 75-2 are directly bonded without using a pipe.

A plurality of the first lower holes 75-1 and the second lower holes 75-2 may be formed so that a flow from the first heat exchange module 30 to the second heat exchange module 40 is smooth.

Furthermore, an upper hole 85 that connects the first upper header 80 and the second upper header 81 may be formed. The upper hole 85 formed in the first heat exchange module 30 is referred to herein as a first upper hole 85-1, and the upper hole 85 formed in the second heat exchange module 40 is referred to herein as a second upper hole 85-2.

In the present embodiment, for example, the first upper hole 85-1 may be formed in the (1-3)-th space 30-4, and the second upper hole 85-2 may be formed in the (2-2)-th space 40-2. It is understood that the upper holes may also be connected through a separate pipe.

The pipe may be disposed between the upper holes or between the lower holes or on the outside. For example, a pipe (not shown) that connects the first lower header 70 and the second lower header 71 may be installed on the outside instead of the lower hole 75. Furthermore, a pipe (not shown) that connects the first upper header 80 and the second upper header 81 may be installed on the outside instead of the upper hole 85.

In the present embodiment, for example, flat tubes 50, that is, 15% of all of the flat tubes of the first heat exchange module 30 and the second heat exchange module 40, may be disposed in the first pass 31. 20% of all of the flat tubes of the first heat exchange module 30 and the second heat exchange module 40 may be disposed in the second pass 32. 30% of all of the flat tubes of the first heat exchange module 30 and the second heat exchange module 40 may be disposed in the third pass.

In the present embodiment, for example, the number of flat tubes of the (3-1)-th pass 33-1 may be the same as that of the (3-2)-th pass 33-2. It is understood that the number of flat tubes of one of the (3-1)-th pass 33-1 and the (3-2)-th pass 33-2 may be larger and the number of flat tubes of the other of the (3-1)-th pass 33-1 and the (3-2)-th pass 33-2 may be smaller. For example, there may be more flat tubes of the (3-2)-th pass 33-2 than that of the (3-1)-th pass 33-1.

The (3-1)-th pass 33-1 and the (3-2)-th pass 33-2 may be distributed and disposed in the two heat exchange modules 30 and 40.

The (3-1)-th pass 33-1 and the (3-2)-th pass 33-2 may be distributed and disposed in different heat exchange modules 30 and 40, but operate like a single pass. In other words, the flow directions of refrigerants in the (3-1)-th pass 33-1 and the (3-2)-th pass 33-2 may be the same.

35% of all of the flat tubes of the first heat exchange module 30 and the second heat exchange module 40 may be disposed in the fourth pass 34.

In the present embodiment, for example, a pressure loss of a refrigerant can be reduced by gradually increasing the number of flat tubes 50 in the passes 31, 32, 33, and 34. The number of passes 31, 32, 33, and 34 can be gradually increased due to the third pass 33 distributed to the two heat exchange modules.

A refrigerant is evaporated within the flat tube 50 because the first heat exchange module 30 and the second heat exchange module 40 operate as the evaporation heat exchanger 20. When a liquefied refrigerant is evaporated as a gaseous refrigerant, specific volume of the refrigerant is increased.

In the present embodiment, for example, the amount of a refrigerant evaporated increases as it moves toward the first pass 31, the second pass 32, and the third pass 33. Accordingly, it is advantageous to gradually increase the volume of each of the passes 31, 32, 33, and 34 in order to reduce pressure loss.

If the number of flat tubes of each pass is identically configured such as in a conventional technology, the dryness of a refrigerant is high in the discharge-side pass. That is, there are problems in that a pressure drop of a refrigerant in a gaseous area increases to deteriorate suction pressure and the circulation flow of the refrigerant is reduced because the volumes of passes are the same compared to a case where the dryness of the refrigerant is great.

In the present embodiment, for example, a pressure loss of a refrigerant can be reduced by gradually increasing the number of flat tubes of each pass. The dryness of a refrigerant can be regularly maintained in each pass by gradually increasing the number of flat tubes of each pass.

Accordingly, the first pass 31 and the second pass 32 may be fabricated less than 50% of the evaporation heat exchanger 20. The third pass 33 may be fabricated 30% to 50% of the evaporation heat exchanger 20. The third pass 33 may be distributed and disposed in the first heat exchange module 30 and the second heat exchange module 40.

A refrigerant flow of the evaporation heat exchanger 20 is described below.

A refrigerant supplied to the inflow pipe 22 may flow along the first pass 31. Accordingly, the refrigerant supplied to the inflow pipe 22 may flow from the (1-1)-th space 30-1 to the (1-2)-th space 30-2, and the refrigerant flowed to the (1-2)-th space 30-2 may flow to the (1-3)-th space 30-3 along the second pass 32. The refrigerant flowed to the (1-3)-th space 30-3 may flow along the third pass 33.

The refrigerant of the (1-3)-th space 30-2 may be divided and flow to the (3-1)-th pass 33-1 or the (3-2)-th pass 33-2 because the third pass 33 includes the (3-1)-th pass 33-1 and the (3-2)-th pass 33-2.

Some of the refrigerant of the (1-3)-th space 30-3 may flow in the (1-4)-th space 30-4 along the (3-1)-th pass 33-1. The refrigerant of the (1-4)-th space 30-4 may flow in the (2-2)-th space 40-2 (i.e., the upper side of the (3-2)-th pass) through the upper hole 85. The refrigerant introduced into the (2-2)-th space 40-2 (i.e., the upper side of the (3-2)-th pass) through the upper hole 85 may flow horizontally along the (2-2)-th space 40-2 and may flow toward the upper side of the fourth pass 34.

The remainder of the refrigerant of the (1-3)-th space 30-3 may flow in the second heat exchange module 40 through the lower hole 75. The remaining refrigerant may flow in the (2-1)-th space 40-1 through the lower hole 75. Furthermore, the refrigerant of the (2-1)-th space 40-1 may flow in the (2-2)-th space 40-2 along the (3-2)-th pass 33-2. That is, the refrigerant of the second pass 32 may flow in the (2-2)-th space 40-2 via any one of the two separated (3-1)-th pass 33-1 and (3-2)-th pass 33-2.

The refrigerants collected in the (2-2)-th space 40-2 may flow along the (2-2)-th space 40-2 and then flow toward the fourth pass 34. The refrigerant passing through the fourth pass 34 may be discharged from the evaporation heat exchanger 20 through the discharge pipe 24.

In the present embodiment, for example, refrigerants passing through the second pass 32 may flow along the (3-1)-th pass 33-1 disposed in the first heat exchange module 30 and the (3-2)-th pass 33-2 disposed in the second heat exchange module 40 and combined in the (2-2)-th space 40-2.

The third passes 33 may be disposed in the different heat exchange modules 30 and 40, but form the same flow direction. The upper hole 85 and the lower hole 75 may be formed so that the separated (3-1)-th pass 33-1 and (3-2)-th pass 33-2 travel in the same direction and are then joined.

Figure 8:
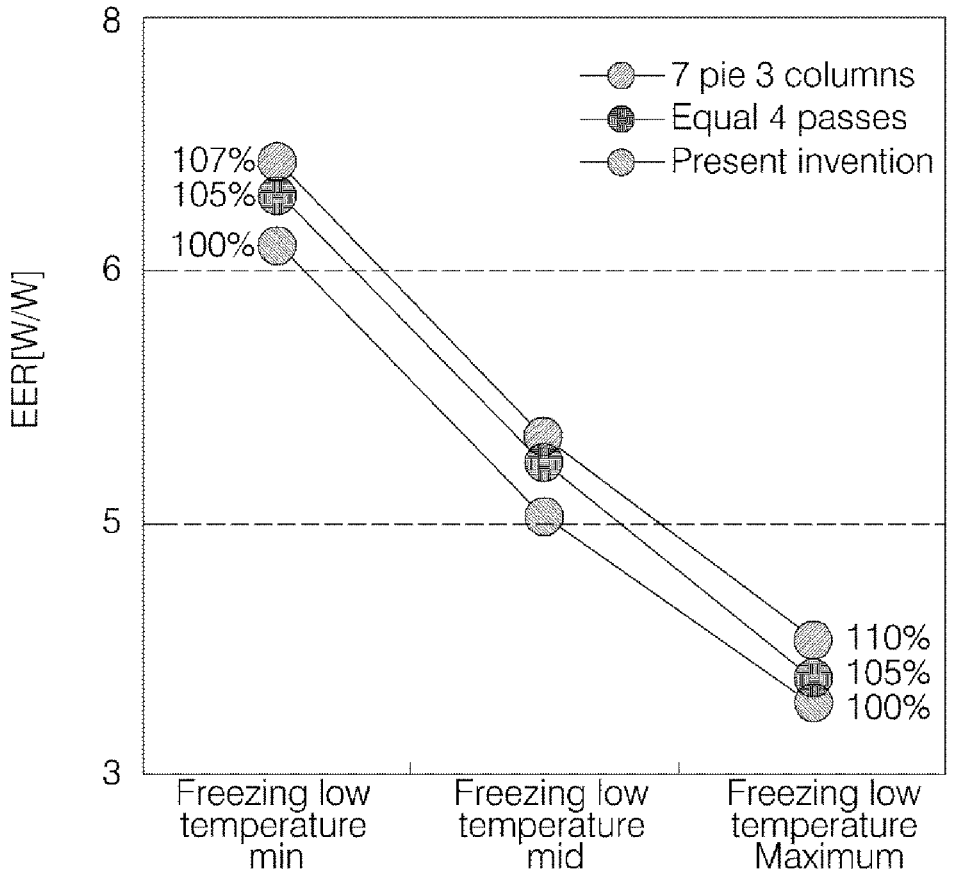
FIG. 8 is a performance graph according to an embodiment of the present disclosure.

FIG. 8 is a performance graph according to an embodiment of the present disclosure.

As shown, the micro channel type heat exchanger of the present embodiment performs better than a conventional heat exchanger having a two-column structure with four equal passes.

The heat exchanger of the present invention has at least one or more of the following effects.

First, as disclosed, embodiments of the present invention are configured to reduce a pressure loss of a refrigerant when the heat exchanger is used as an evaporator because the number of flat tubes of each of the first pass, the second pass, and the third pass is gradually increased.

Second, as disclosed, embodiments of the present invention are configured such that the (3-1)-th pass disposed in the first heat exchange module and the (3-2)-th pass disposed in the second heat exchange module operate as a single pass.

Third, as disclosed, embodiments of the present invention are configured such that a ratio of the flat tubes of the third pass to the number of all of flat tubes can be controlled because the third pass is distributed and disposed in the two heat exchange modules.

Fifth, as disclosed, embodiments of the present invention are configured such that there can be a reduction in pressure loss generated when a refrigerant evaporates because the third pass is separated into the two passes 33-1 and 33-2 of different heat exchange modules and thus the refrigerant flows in the two passes 33-1 and 33-2, but flows in the same direction.

Although the embodiments of the present invention have been described with reference to the accompanying drawings, the present invention is not limited to the embodiments, but may be manufactured in various other forms. Those skilled in the art to which the present invention pertains will appreciate that the present invention may be implemented in other detailed forms without departing from the technical spirit or essential characteristics of the present invention. Accordingly, the aforementioned embodiments should be construed as being only illustrative from all aspects not as being restrictive.

What is claimed is:

1. A micro channel type heat exchanger comprising:

a first pass disposed in some of a plurality of flat tubes disposed in a first heat exchange module and along which a refrigerant flows in one direction;

a second pass disposed in a remaining some of the plurality of flat tubes disposed in the first heat exchange module and along which the refrigerant supplied from the first pass flows in an opposite direction to a direction of the first pass;

a third pass distributed and disposed in a remainder of the plurality of flat tubes disposed in the first heat exchange module other than the some of the plurality of flat tubes and the remaining some of the plurality of flat tubes disposed in the first heat exchange module, and in some of a plurality of flat tubes disposed in a second heat exchange module; and a fourth pass disposed in a remainder of the plurality of flat tubes disposed in the second heat exchange module other than the some of the plurality of flat tubes disposed in the second heat exchange module and along which the refrigerant supplied from the third pass flows in an opposite direction to a direction of the third pass, wherein the third pass comprises a 3-1th pass disposed in the remainder of the plurality of flat tubes disposed in the first heat exchange module and along which the refrigerant supplied from the second pass flows in a direction of the 3-1th pass in an opposite direction to the direction of the second pass, and a 3-2th pass disposed in some of the plurality of flat tubes disposed in the second heat exchange module and along which the refrigerant supplied from the second pass flows in the opposite direction to the direction of the second pass and flows in a same direction as the direction of the 3-1th pass, wherein a fin is disposed between every adjacent two flat tubes of the plurality of flat tubes disposed in the respective same first or second heat exchange module and every adjacent two flat tubes of the plurality of flat tubes disposed in the second heat exchange module module to conduct heat, wherein the heat exchanger further comprises:

a first separation space provided between the first pass and the second pass, a second separation space provided between the second pass and the 3-1th pass, and a third separation space provided between the 3-2th pass and the fourth pass, and wherein none of the fins is disposed in each of the first to third separation spaces.

2. The micro channel type heat exchanger of claim 1, wherein a number of the plurality of flat tubes disposed in the first and second heat exchange modules disposed in each of the first pass, the second pass, the third pass, and the fourth pass is gradually increased.

3. The micro channel type heat exchanger of claim 2, wherein the third pass comprises 30% to 50% of all of the plurality of flat tubes disposed in the first heat exchange module and the second heat exchange module.

4. The micro channel type heat exchanger of claim 1, wherein the 3-1th pass and the 3-2th pass are connected together.

5. The micro channel type heat exchanger of claim 1, wherein:

the first heat exchange module comprises:

the plurality of flat tubes disposed in the first heat exchange module configured to have the refrigerant flow along the plurality of flat tubes disposed in the first heat exchange module, a first lower header connected to a first side of the plurality of flat tubes disposed in the first heat exchange module, the first lower header being in communication with the first side of the plurality of flat tubes disposed in the first heat exchange module so that the refrigerant flows, a first upper header connected to a second side of the plurality of flat tubes disposed in the first heat exchange module, the first upper header being in communication with the second side of the plurality of flat tubes disposed in the first heat exchange module so that the refrigerant flows, a first baffle disposed within the first lower header and configured to form the first pass and the second pass by partitioning an inside of the first lower header, and a second baffle disposed within the first upper header and configured to form the second pass and the (3-1)-th pass by partitioning an inside of the second upper header; and the second heat exchange module comprises:

the plurality of flat tubes disposed in the second heat exchange module configured to have the refrigerant flow in the plurality of flat tubes disposed in the second heat exchange module, a second lower header connected to a first side of the plurality of flat tubes disposed in the second heat exchange module, the second lower header being in communication with the first side of the plurality of flat tubes disposed in the second heat exchange module so that the refrigerant flows, a second upper header connected to a second side of the plurality of flat tubes disposed in the second heat exchange module, the second upper header being in communication with the second side of the plurality of flat tubes disposed in the second heat exchange module so that the refrigerant flows, and a third baffle disposed within the second lower header and configured to form the (3-2)-th pass and the fourth pass by partitioning the second lower header.

6. The micro channel type heat exchanger of claim 5, further comprising:

an inflow pipe to supply the refrigerant, the inflow pipe being disposed in the first lower header; and a discharge pipe to discharge the refrigerant, the discharge pipe being disposed in the second lower header.

7. The micro channel type heat exchanger of claim 5, wherein:

a first upper hole is provided in the first upper header, and a second upper hole is provided in the second upper header, whereby some of the refrigerant of the third pass flows in the second upper header through the first upper hole and the second upper hole.

8. The micro channel type heat exchanger of claim 5, wherein:

a first lower hole is provided in the first lower header, and a second lower hole is provided in the second lower header, whereby some of the refrigerant of the third pass flows in the second lower header through the first lower hole and the second lower hole.

9. The micro channel type heat exchanger of claim 5, wherein:

a first upper hole is provided in the first upper header, a second upper hole is provided in the second upper header, and some of the refrigerant of the third pass flows in the second upper header through the first upper hole and the second upper hole, and a first lower hole is provided in the first lower header, a second lower hole is provided in the second lower header, and a remainder of the refrigerant of the third pass flows in the second lower header through the first lower hole and the second lower hole.

10. The micro channel type heat exchanger of claim 9, wherein a number of flat tubes of the plurality of flat tubes disposed in the first heat exchange module forming the 3-1th pass is the same as a number of flat tubes of the plurality of flat tubes disposed in the second heat exchange module forming the 3-2th pass.

11. The micro channel type heat exchanger of claim 5, wherein a number of the plurality of flat tubes disposed in the first and second heat exchange modules disposed in each of the first pass, the second pass, the third pass, and the fourth pass is gradually increased.

12. The micro channel type heat exchanger of claim 5, wherein:

the first baffle is disposed over or under the first separation space, the second baffle is disposed over or under the second separation space, and the third baffle is disposed over or under the third separation space.

13. The micro channel type heat exchanger of claim 5, wherein the 3-1th pass and the 3-2th pass are connected through the first lower header and the second lower header and are connected through the first upper header and the second upper header.

* * * * *